United States Patent [19]

Rogers et al.

[11] Patent Number: 4,999,752

[45] Date of Patent: Mar. 12, 1991

[54] ELECTRIC LAMP WITH MULTIPLE POWER CONNECTORS

[76] Inventors: Jack Rogers; James Sweet, both of P.O. Box 404, Hillsboro, Ohio 45133

[21] Appl. No.: 447,000

[22] Filed: Dec. 6, 1989

[51] Int. Cl.[5] ..... F21L 1/00

[52] U.S. Cl. ..... 362/228; 362/227; 362/376; 315/165

[58] Field of Search ..... 362/20, 227, 228, 376, 362/377, 378, 211; 315/161, 163, 165, 166, 175, 176

[56] References Cited

U.S. PATENT DOCUMENTS

| | | | |
|---|---|---|---|
| 2,812,423 | 11/1957 | Penna | 362/376 |
| 2,863,638 | 12/1958 | Lombardo | 362/20 |
| 4,136,381 | 1/1979 | Bone | 362/376 |
| 4,310,874 | 1/1982 | Spiteri | 362/376 |

FOREIGN PATENT DOCUMENTS

| | | | |
|---|---|---|---|
| 537370 | 3/1922 | France | 362/211 |

*Primary Examiner*—Ina Lazarus
*Assistant Examiner*—Richard Cole
*Attorney, Agent, or Firm*—Price, Gess & Ubell

[57] ABSTRACT

A light fixture assembly having both AC and DC lamps, as well as AC and DC power receptacles that is capable of operating from either an AC source or a DC source. A 110-volt AC lamp, as well as a 12-volt DC lamp are provided within a reflector housing. The reflector housing has a mask that fits onto the reflector housing. An insulating handle that contains a switch that controls AC power to the AC lamp provides insulation and improved gripping ability for a user. An electrical cord provides electrical current for both the AC and DC lamps. The electrical cord has a pair of adapters, that are compatible with first, a 110-volt AC outlet, for providing power to the AC lamp. Secondarly, the other adapter is compatible with a receptacle used for an automobile cigarette lighter, for providing power to the DC lamp.

5 Claims, 3 Drawing Sheets

ELECTRIC LAMP WITH MULTIPLE POWER CONNECTORS

BACKGROUND OF THE INVENTION

1. Field of the Invention

The present invention is directed towards a light fixture that can operate from either an alternating current (AC) or a direct current (DC) power source and, more particularly, to a light fixture with a pair of light bulbs that can produce light from available power sources.

2. Description of Related Art

It is known within the lighting industry that having a light that can operate from either an AC or a DC power source is extremely desirable. For example, conventional trouble lights operate only from an AC current. As can be readily appreciated, there are instances where a trouble light operating off of a car battery would be extremely useful to the owner of the trouble light in instances where he is stranded at night on a road.

U.S. Pat. No. 4,310,874 provides a grounded trouble light that can operate from both AC and DC power sources. It requires a special lamp containing two filaments, one operating in a DC mode, the other operating in an AC mode The electrical cord normally provides for AC operation by attachment to an AC receptacle, and a DC adapter permits attachment to automotive battery terminals in order to energize the DC filament.

Patents of general interest in this field are U.S. Pat Nos. 4,388,673, 4,463,283, 4,322,782, and 4,535,397.

There is still a demand in the prior art to provide a relatively simple and economical AC/DC light fixture assembly capable of providing ample light from either an AC power source or a DC power source. Additionally, the requirement for a useful AC/DC light fixture that is also economical has not yet been satisfied by the prior art.

SUMMARY OF THE INVENTION

The present invention provides a trouble light fixture assembly that is capable of being attached to either a receptacle which is compatible with an automobile cigarette lighter or a normal AC power receptacle. AC and DC lamps are provided within the reflector housing AC and DC power adapters are integrated with the power cord. Therefore, power can be supplied from either an AC or a DC source without any modification of the trouble light.

The present invention provides a 110-volt AC lamp, as well as a 12-volt DC lamp. A fixture capable of holding both the AC and DC lamps is included with the invention. The fixture has a mask that fits onto the fixture. An insulating handle that contains a switch that controls AC power to the AC lamp provides insulation for the user, as well as gripping ability Also, an electrical cord provides electrical current for both the AC and the DC lamps is provided The electrical cord has a pair of adapters, which are compatible with first, a 110-volt AC outlet, thus providing power to the AC lamp. Secondly, the other adapter is compatible with a receptacle used for an automobile cigarette lighter, thus providing power to the DC lamp.

The features of the present invention which are believed to be novel are set forth with particularity in the appended claims. The present invention, both as to its organization and manner of operation, together with objects and advantages thereof, may best be understood by reference to the following description taken in conjunction with the accompanying drawings

DESCRIPTION OF THE PREFERRED EMBODIMENTS

Figure 1:
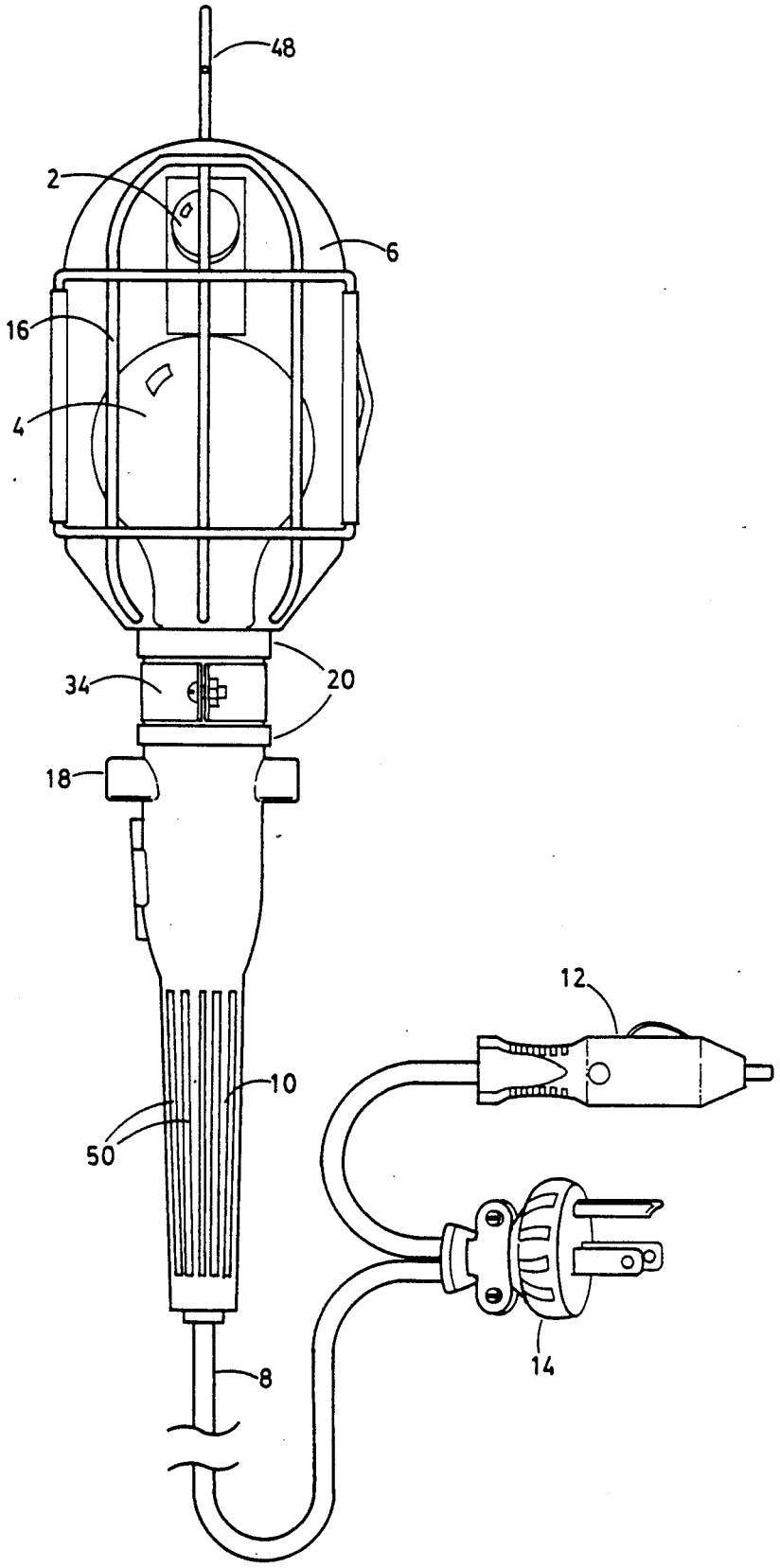
FIG. 1 is a frontal view of the trouble light fixture showing both the AC and DC lamps and the AC and DC plugs.
Figure 2:
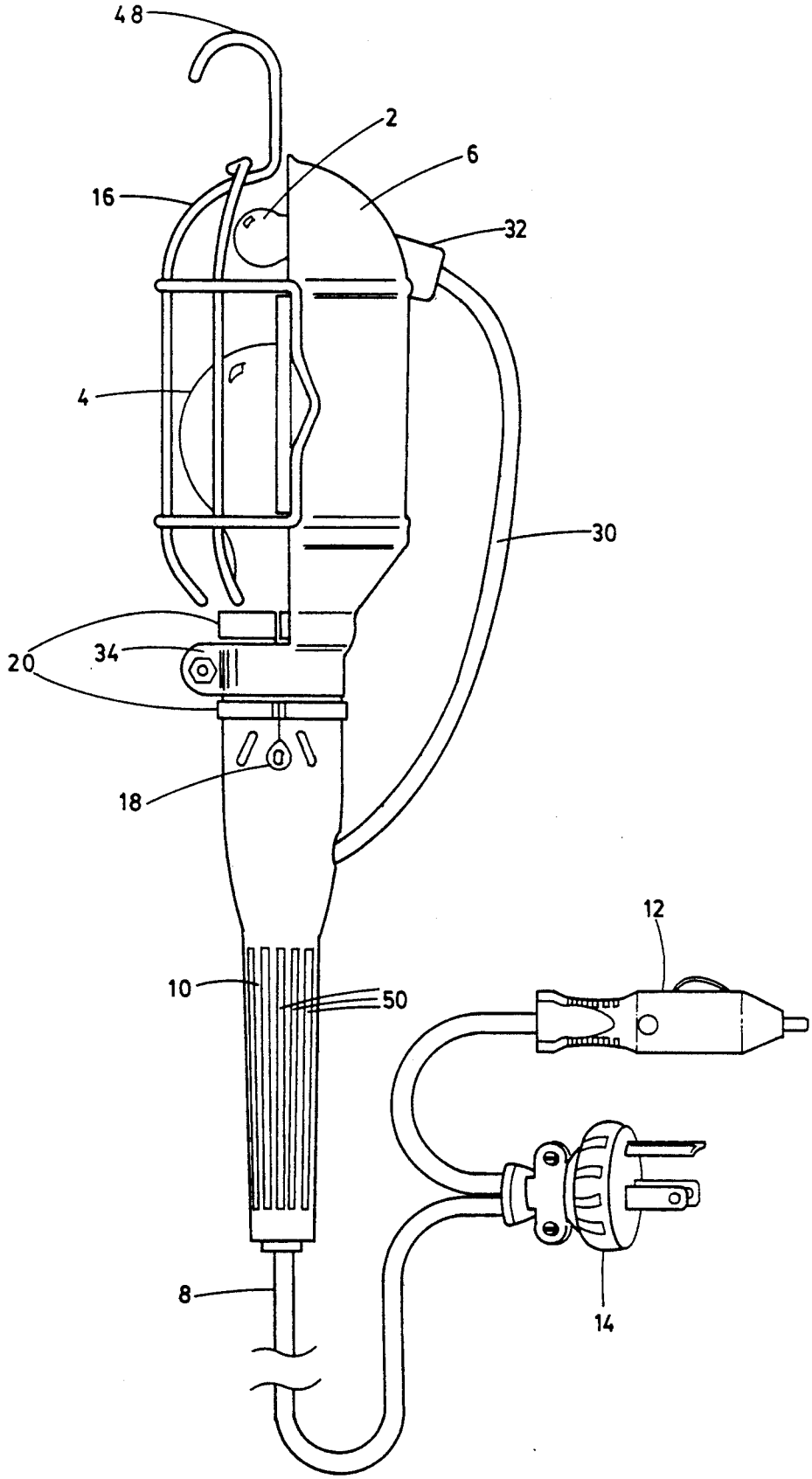
FIG. 2 is a side view of the trouble light fixture, again showing both the AC and DC lamps and the AC and DC plugs.
Figure 3:
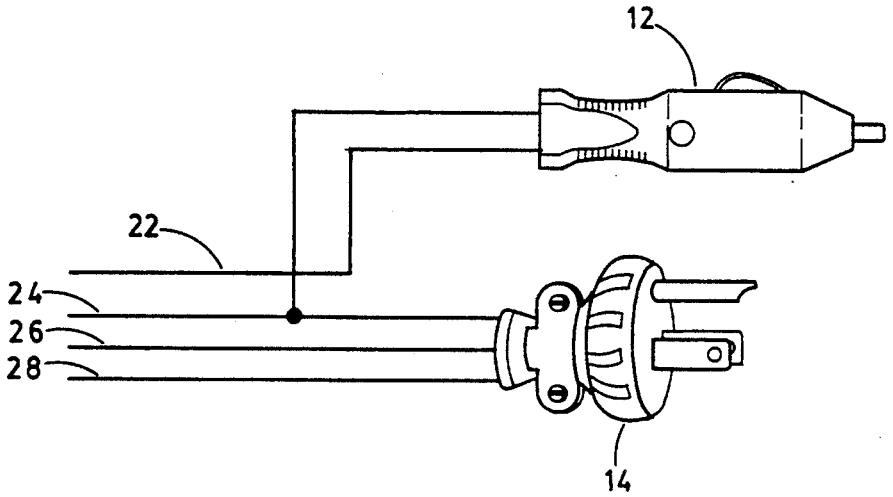
FIG. 3 is a cutaway schematic of the electrical cord as it interfaces with the AC and DC plugs.

The following description is provided to enable any person skilled in the lighting industry to make and use the invention, and sets forth the best modes contemplated by the inventor of carrying out his invention. Various modifications, however, will remain readily apparent to those skilled in the art, since the generic principles of the present invention have been defined herein specifically to provide for a relatively easily manufactured trouble light fixture Referring to FIGS. 1 and 2, a trouble light that will operate with an electrical connection to either an AC or a DC power receptacle is shown. Two lamps are provided, one for DC operation, and another for AC operation.

The first lamp 4 can be any AC light bulb mounted at the base of the housing fixture 6. The second lamp 2, used for DC operation is a commercially available 12-volt DC light bulb. It is mounted in a housing fixture 6 along with the first lamp 4. The housing fixture 6 that holds onto both the AC and the DC lamps is constructed of a single piece of diffuse reflective sheet metal that is stamp molded into an essentially semicylindrical shape. The AC and DC lamps are then mounted along the central longitudinal axis of the cylindrically shaped fixture 6 with one lamp at each end. The fixture 6 has a first end wherein the semicylindrical shape curves and forms one-quarter of a sphere. The DC lamp 2 is contained within the spherically-shaped portion of the fixture. There is a second end of the housing fixture 6 that has the cylindrical shape of the fixture gradually tapering to finally form a split annular ring 34. The split annular ring 34 provides for attachment to handle 10 by attaching to a set of molded rings 20 on the side of the handle. A bolt then holds the split annular ring 34 in place on the rings 20 of the handle 10.

The handle itself is composed of a durable insulating plastic that is essentially cylindrical in shape. The AC lamp socket fits into the first end of the handle, while the split annular ring 34 of the housing fixture attaches to plastic rings 20 molded into the end of the handle containing the AC lamp socket The annular ring 34 is then bolted securely around the plastic rings 20. The cylindrically shaped handle has a tapering second end opposite the end that connects to the light fixture for the first lamp. An electrical cord passes through an aperture contained within the tapering end, and passes through the inside of the handle to a switch assembly. The handle in the preferred embodiment has ridges 50 on it to improve the gripping ability of the handle. There is a switch assembly 19 embedded inside the handle near the end that attaches to the light fixture. The switch assembly 19 enables the electrical power to the AC lamp and is part of an interface between the electrical cord 8 and the respective lamps The switch is controlled by a pushbutton 18. The pushbutton 18 controls the continuity of the circuit between the power adapters and the AC lamps.

The electrical interface that includes the switch assembly is contained within the handle The conductors contained within the electrical cord bifurcate at the interface from a single set of conductors into two sets of conductors. The interface then consists of one set of conductors being electrically connected to the switch assembly 19. The switched equivalent then interfaces with the first AC lamp. The second set of conductors interfaces directly with the second lamp. The electrical cord contains a set of four conductors. The set of four conductors bifurcate at the end of the electrical cord opposite that of the interface to connect to two power adapters. The first power adapter is a DC power adapter 12, and the second power adapter is an AC power adapter 14. The DC adapter has, running into it, a first conductor 22 which is the 12-volt line which provides power for the first lamp 2 via the DC adapter 12. One of the conductors is common to both the DC power adapter 12 and the AC power adapter 14. This is the second conductor 24, which is ground for both adapters. The AC adapter has a total of three conductors attached to it. As mentioned above, the second conductor 24 is ground and is attached to the AC adapter. The third conductor 26 is a 110-volt AC return, which connects to the AC adapter at one end of the electrical cord and provides for the return of 110-AC volt current from the second lamp, which is the AC lamp 4. The last conductor 28 on the AC adapter is a 110-volt main power line, which adapts to the AC adapter at one end and to the AC lamp on the other end.

There is also contained within the assembly a hinged mask 16 which provides for protection of both the AC and DC lamps, while enabling light to pass through the crossed members of the mask. A hook 48 is provided on the mask which enables attachment of the light fixture while the light fixture is in use. The mask is formed in such a manner as to essentially complete the shape of the housing fixture. Throughout the center portion the mask is cylindrical in shape Towards the first end of the fixture containing the 12-volt DC lamp, the cylindrical shape of the mask curves in unison with that of the fixture to become spherically shaped. The end of the mask then forms a quarter sphere as does the end of the fixture, and in combination they form a semisphere. At the opposite end the mask tapers in conjunction with the fixture.

What is claimed is:

1. A trouble light fixture capable of both AC and DC operation, comprising:

a pair of lamps, said lamps including a first lamp capable capable of 110-VAC operation and a second lamp capable of 12-VDC operation;

a reflecting fixture, having a first end and a second end, said fixture being cylindrically shaped in the center;

a quarter-sphere formed at said first end of said fixture by the cylindrically shaped curve to form said quarter-sphere;

an aperture contained within the boundary of said quarter-sphere of the size and type required to house said second lamp;

means for securing to said first lamp formed at the second end of said fixture;

a hinged mask attached to said fixture to provide for protection of said lamps and allowing light to pass through said mask;

a cylindrically-shaped insulated handle, said handle having a first end and a second end;

means for mounting said first lamp within said first end of said handle and fixedly attaching said first end of said handle to said second end of said fixture;

an electrical cord having a first end attached to said second end of said handle and a second end having means for providing power to both of said first and second lamps;

a set of receptacle adapters at the second end of said electrical cord capable of adapting to Ac and DC current receptacles required to provide said lamps with their respective required current; and means for switching power to said first lamp contained within said handle.

2. The light fixture of claim 1 in which said electrical cord further comprises a set of four conductive wires comprising:

a first conductive wire being ground for both said first and second lamps and attached to both of said adapters;

a second conductive wire providing 12-VDC to said second lamp being attached to both said second lamp and said second adapter;

a third conductive wire providing 110 VAC to said first lamp being attached to said switch and said first adapter; and a fourth conductive wire providing 110 VAC return for said third conductive wire, being attached to said first adapter and said first lamp.

3. The light fixture of claim 1 wherein an interface connects said switching means to said first lamp such that said first lamp is electrically connected to said first adapter in such a manner as to form a complete circuit when the switch is in the on position.

4. A light capable of either AC or DC operation, comprising:

a pair of lamps including a first lamp capable of 110-VAC operation and a second lamp capable of 12-VDC operation;

a fixture that is semicylindrically shaped towards its center and capable of holding said first lamp and said second lamp so that said lamps are mounted along the longitudinal axis of said fixture;

said fixture having a first end curving to form a quarter-sphere, the boundary of said first end defining a circular aperture of the size and type to fixedly attach a light socket of the type required to accommodate said second lamp;

a second end to said semicylindrically-shaped fixture formed by the cylindrical shape tapering towards said second end to form a split annular ring capable of securing said first lamp;

a hinged mask, constructed of crossed members, attached to said light fixture, said mask having a shape that tends to complete the shape of said fixture, being essentially cylindrically shaped along main body of said fixture and being semispherically shaped in conjunction with said first end of said fixture and tapering to virtually meet said ring at said second end of said fixture;

a hollow cylindrical insulating handle having a first end defining an aperture of the size and shape to accommodate a light socket for said first lamp, said first end also having a pair of ridges at said first end of said handle to secure said split ring of said light fixture;

a switch near said first end and inside of said handle to enable and disable power to said first lamp;

a second end to said handle having the first end of an electrical cord passing through an aperture defined by the second end of said handle;

a pair of power adapters connected to the second end of said electrical cord, said pair of power adapters consisting of a first power adapter being a three-pronged 110-VAC plug, and a second power adapter being a 12-VDC plug compatible with the receptacles typically used with cigarette lighters for vehicles;

said electrical cord having a set of four conductors comprising:

a first conductor being ground for both said first and second lamps and attached to both of said plugs;

a second conductor providing 12-VDC to said second lamp being attached to both said second lamp and said DC plug;

a third conductor providing 110 VAC to said first lamp being attached to said switch and said AC plug, and a fourth conductor providing 110 VAC return for said third conductor, being attached to said AC plug and said first lamp, and an interface from said switch to said first lamp, said interface providing AC power to said first lamp when said switch is in the on position, whereby said first lamp will be illuminated when said AC power adapter is placed in a proper AC receptacle and said switch is placed in the on position, or said second lamp will be illuminated when said DC power adapter is placed in a receptacle that is compatible with an automobile cigarette lighter

5. A trouble light fixture capable of both AC and DC operation, which comprises:

a pair of light bulbs including a first light bulb for 110-VAC power operation and a second light bulb for 12- VDC power operation;

a metallic housing fixture that is semicylindrically shaped towards its center and capable of holding said first light bulb and said second light bulb so that said light bulbs are mounted along the longitudinal axis of said fixture, said fixture having a first end curving to form a quarter-sphere, the boundary of said first end defining a circular aperture of the size and type required to accommodate said second light bulb, and a second end to said semicylindrically-shaped fixture formed by the cylindrical shape tapering towards said second end to form a split annular ring for securing said first light bulb;

a hinged mask for providing protection to said first and second light bulbs, said mask constructed of crossed members and attached to said housing fixture, said mask having a shape that tends to complete the shape of said fixture, being essentially cylindrically shaped along the main body of said fixture and being semispherically shaped in conjunction with said first end of said fixture and tapering to substantially meet said ring at said second end of said fixture;

an essentially cylindrical hollow plastic insulating handle having a first end defining an aperture wherein a light socket for said first light bulb is disposed, said first end further having a pair of ridges to secure said split ring of said housing fixture therebetween, said handle having a second end defining an aperture;

a connecting means comprising an electrical cord and a pair of receptacle adapters, said electrical cord having a first end capable of passing through said aperture in said second end of said handle and having a second end, said pair of receptacle adapters coupled to the second end of said electrical cord; said pair of receptacle adapters consisting of a first power adapter of a three-pronged 110-VAC plug, and a second power adapter of a 12-VDC plug of a shape compatible with the receptacles typically used with cigarette lighters for vehicles; said electrical cord further having a set of four conductive wires comprising:

a first conductive wire being ground for both of said first and second light bulbs and attached to both of said plugs;

a second conductive wire providing 12-VDC to said second light bulb being attached to both said second light bulb and said DC plug;

a third conductive wire providing 110 VAC to said first light bulb being attached to said switch and said AC plug; and a fourth conductive wire providing 110 VAC return for said third conductive wire, being attached to said AC plug and said first light bulb;

an AC pushbutton switch assembly located at the first end and inside of said handle for activating and deactivating AC power to said first light bulb; and an interface connecting said switch to said first light bulb such that said first light bulb is electrically connected to said first adapter in such a manner as to form a complete circuit when the switch is in the on position, whereby said first light bulb will be illuminated when said AC power adapter is placed in a proper AC receptacle and said switch is placed in the on position, or said second light bulb will be illuminated when said DC power adapter is placed in a receptacle that is compatible with an automobile cigarette lighter.

* * * * *